US009610708B2

(12) United States Patent
Stichel et al.

(10) Patent No.: US 9,610,708 B2
(45) Date of Patent: Apr. 4, 2017

(54) APPARATUS FOR THE PRODUCTION OF MOLDED CONCRETE PARTS IN A MOLDING MACHINE

(71) Applicant: KOBRA Formen GmbH, Lengenfeld (DE)

(72) Inventors: Holger Stichel, Lengenfeld (DE); Juergen Braungardt, Blaustein (DE)

(73) Assignee: KOBRA Formen GmbH, Legenfeld (DE)

( * ) Notice: Subject to any disclaimer, the term of this patent is extended or adjusted under 35 U.S.C. 154(b) by 0 days.

(21) Appl. No.: 15/070,209

(22) Filed: Mar. 15, 2016

(65) Prior Publication Data

US 2016/0271828 A1 Sep. 22, 2016

(30) Foreign Application Priority Data

Mar. 16, 2015 (DE) ..... 10 2015 103 829

(51) Int. Cl.

| | |
|---|---|
| ***B28B 7/08*** | (2006.01) |
| ***B28B 3/02*** | (2006.01) |
| ***B30B 15/04*** | (2006.01) |
| ***B28B 7/00*** | (2006.01) |
| ***B28B 7/24*** | (2006.01) |

(52) U.S. Cl.

CPC ..... *B28B 7/08* (2013.01); *B28B 3/028* (2013.01); *B28B 7/0097* (2013.01); *B28B 7/24* (2013.01); *B30B 15/041* (2013.01)

(58) Field of Classification Search

CPC .. B28B 3/02; B28B 3/028; B28B 3/04; B28B 7/0097; B28B 7/08; B28B 7/082; B28B 7/24

See application file for complete search history.

(56) References Cited

U.S. PATENT DOCUMENTS

| | | | | |
|---|---|---|---|---|
| 2,479,350 A * | 8/1949 | Haggart, Jr. | ..... | B29C 43/00 220/DIG. 23 |
| 4,941,813 A * | 7/1990 | Grubb, Jr. | ..... | B28B 7/0014 100/918 |
| 7,575,700 B2 * | 8/2009 | Ishler | ..... | B28B 3/028 264/297.9 |

FOREIGN PATENT DOCUMENTS

| | | | |
|---|---|---|---|
| DE | 36 38 207 A1 | | 5/1988 |
| DE | 199 24 926 A1 | | 4/2000 |
| DE | 10 2004 004 188 | * | 10/2005 |
| DE | 10 2005 048 930 A1 | | 5/2006 |

* cited by examiner

*Primary Examiner* — James Mackey
(74) *Attorney, Agent, or Firm* — Collard & Roe, P.C.

(57) ABSTRACT

An apparatus for the production of concrete molded parts in a molding machine includes an upper mold part having at least one pressure punch for transfer of a force to at least one pressure plate, wherein the pressure plate can be introduced into an opening of a mold insert in a lower mold part in the vertical direction, wherein the lower mold part is surrounded by a frame that has a guide connected with the upper mold part and configured so that, the lower mold part can be tilted from the vertical direction, relative to the upper mold part, during engagement of the pressure plates into the openings of the mold insert.

11 Claims, 5 Drawing Sheets

APPARATUS FOR THE PRODUCTION OF MOLDED CONCRETE PARTS IN A MOLDING MACHINE

CROSS REFERENCE TO RELATED APPLICATIONS

Applicant claims priority under 35 U.S.C. §119 of German Application No. 10 2015 103 829.3 filed Mar. 16, 2015, the disclosure of which is incorporated by reference.

BACKGROUND OF THE INVENTION

1. Field of the Invention

The invention relates to an apparatus for the production of molded concrete parts in a molding machine.

2. Description of the Related Art

Apparatuses for the production of molded concrete parts, such as paving bricks, for example, are typically used for machine production and contain a molding machine having a punch unit and a lower mold part configured as a mold, into which the punch unit can engage. Usually, one mold insert is or a number of mold, inserts are configured in the lower mold part, whose cavities are open toward the top and the bottom. The lower mold part is set onto a horizontal bed with a lower delimitation plane of a brick field, which bed closes off the lower openings of the mold. The mold inserts are filled with concrete mixture through the upper openings; this mixture is subsequently pressed by way of pressure plates disposed on the punch unit, in that the pressure plates are lowered into the mold inserts through the upper openings. Subsequently, solidification of the concrete mixture to form, shape-stable molded concrete parts takes place by means of shaking, typically of the bed. The parts are unmolded through the lower openings of the mold inserts.

The punch unit is connected with a vertical movement unit of the molding machine, which unit is typically hydraulically activated, and can be displaced vertically by means of this unit. The connection can be made, in a conventional design, by way of a top-load unit, which, together with the punch unit, usually forms an upper mold part as a module that can be handled as one part. A uniform brick height is achieved even with different compaction of the concrete mixture, by means of a stop on the punches of the punch unit.

In known molding machines, the connection between the upper mold part and the lower mold part has particular significance. Thus, it is known, for example from DE 36 38 207 A1, that in the case of such molds, there is a risk of collision of the pressure punch with the top side of the lower mold part in the case of insufficient alignment of the upper mold part relative to the lower mold part. This risk particularly occurs when the upper mold part is guided into the lower mold part in the molding machine, in order to form and compact the molded concrete part to be produced. According to solutions known from the state of the art, an attempt was made to circumvent this risk by precisely aligning the upper mold part with the lower mold part, and providing corresponding introduction bevels on the mold inserts, which facilitate introduction of the pressure plates.

The connection between upper mold part and lower mold part, however, was also investigated in greater detail in the state of the art, in a different connection. Thus, a brick molding machine is known from DE 199 24 926 A1, on the guide columns of which machine a brick mold that can be moved up and down is disposed. The brick mold consists of a lower mold part and an upper mold part, which are disposed so that they either can be firmly connected with one another or can be displaced relative to one another, depending on the work cycle. This arrangement allows simple further processing, particularly by means of a pull-off mechanism, which separates lower mold part and upper mold part from one another.

A brick mold for the production of concrete bricks is known from DE 10 2005 048 930 A1; this mold comprises an upper mold part having at least one punch having a pressure piece, and a lower mold part having at least one mold insert, for use in a brick molding machine, wherein the lower mold part can be moved up and down in a brick molding machine. The lower mold part can be laid down onto a mold bed of the brick molding machine, and the upper mold part can be coupled with a machine accommodation of the brick molding machine, which accommodation can be moved up and down. A filling box of the brick molding machine can be moved over the lower mold part, and the upper mold part and/or the lower mold part has play relative to a machine frame of the brick molding machine. In this connection, a centering device is provided for alignment of the lower mold part and of the upper mold part in an xy plane. In this regard, precise centering of the two mold parts relative to one another is brought about, wherein a conical section of the centering device slowly releases centering of the mold parts again after dipping of the pressure piece into the mold insert.

SUMMARY OF THE INVENTION

If is the task of the invention to create an apparatus for the production of molded concrete parts in a molding machine, in which centering between upper mold part and lower mold part is further improved, particularly in order to prevent damage to pressure plates if they possibly make contact with side walls of the mold insert.

This task is accomplished by means of an apparatus according to the invention. Further advantageous embodiments of the invention are discussed below. These embodiments can be combined with one another in technologically practical manner. The description, particularly in connection with the drawing, additionally characterizes and specifies the invention.

According to the invention, an apparatus for the production of concrete molded parts in a molding machine is created, which apparatus comprises an upper mold part having at least one pressure punch for transfer of a force to at least one pressure plate, wherein the pressure plate can be introduced into an opening of a mold insert in a lower mold part in the vertical direction, wherein the lower mold part is surrounded by a frame that has a guide means connected with the upper mold part, which means is configured in such a manner that the lower mold part can be tilted from the vertical direction, relative to the upper mold part, during engagement of the pressure plates into the openings of the mold insert.

According to the invention, the lower mold part is therefore connected with the upper mold part not with a compulsory guide that merely would allow establishment of relative positions between upper mold part and lower mold part. It has surprisingly been shown that a guide means that allows tilting of the upper mold part from the vertical direction allows greater stability and longer useful lifetimes of the pressure plates attached to the pressure punch, because fine structures, in particular, such as indentations or chamfers on the pressure plates, demonstrate less wear. The solution according to the invention thereby does not attempt to focus on correct and centered installation of the lower mold part relative to the upper mold part, in order to be able to prevent the pressure plate from touching an opening of the mold, but rather makes it possible to keep effects low in the case of possible touching, by means of procurement of an additional degree of freedom in the movement of the pressure plates. In addition, a starting position for the location of the lower mold part relative to the upper mold part is created by means of the guidance of the lower mold part in the guide means, which position can result in contact-free introduction of the pressure plates. Instead of predetermining the precise relative positioning, which is furthermore rigidly predetermined in previous systems known from the state of the art, however, the invention permits a type of self-adjustment, so that useful lifetimes that have not been achieved until now can be achieved by means of the possibility of tilting and, if necessary, rotation.

According to an embodiment of the invention, the guide means is disposed on two opposite sides of the frame, in each instance.

Accordingly, it is possible to split the guide means into individual components, wherein it is considered to be sufficient to provide only two sides of the frame, which lie opposite one another, with parts of the guide means. In this connection, in the case of a rectangular mold insert, for example, one part of the guide means, in each instance, can be disposed on the two shorter sides of the mold insert, lying opposite one another, in the region of a corner of the mold insert. Such a configuration allows tilting of the lower mold part relative to the upper mold part, for one thing, and nevertheless allows establishment of a defined starting position.

According to a further embodiment of the invention, the guide means comprises an elongated body configured along the vertical direction, having parallel side lines relative to the vertical direction, at least in certain sections, which body engages into a passage that corresponds to it, at least in part.

The guide means can be formed, in simple manner, by means of an elongated body that is passed through a corresponding passage. One possibility consists in that the elongated body has an outer surface that is selected to be parallel to an inner dimension of the passage over the complete expanse of the body. In this regard, however, it is also possible that at least individual sections of the elongated body or parts of the passage are structured as depressions having surfaces that lie farther on the inside, so that these cannot enter into contact with the corresponding part, in each instance. Such embodiments, however, are not excluded, within the scope of the invention. In order to allow tilting of the lower mold part relative to the upper mold part, according to the invention, it is merely provided that play that restricts the tilting exists between the outer circumference of the elongated body and the inner circumference of the passage.

According to a further embodiment of the invention, the elongated body is connected with the upper mold part, and the passage is connected with the lower mold part.

A particularly simple implementation of the guide means disposes the passage in the lower mold part and provides the upper mold part with the elongated body. Accordingly, the embodiment of a lower mold part that has usually been used in molding machines until now can continue to be used, wherein a corresponding passage merely has to be present.

According to a further embodiment of the invention, the elongated body and the passage have dimensions that are selected in such a manner that a maximal value of the tilting of the lower mold part relative to the upper mold part is predetermined.

In order to restrict the tilting of the lower mold part relative to the upper mold part, i.e. to define a maximal value of the tilting, it is particularly provided that the elongated body and the passage perform a corresponding movement restriction on the basis of their dimensions. It is therefore not necessary to provide additional components for a restriction of the tilting, and this arrangement additionally simplifies the production of the apparatus according to the invention.

According to a further embodiment of the invention, the lower mold part can be tilted relative to the upper mold part by an angle that lies in the range of less than 2° and particularly amounts to approximately 1°.

In order to achieve the improvement in useful lifetimes of pressure plates when used in molding machines as mentioned initially, it is not necessary to permit tilting between lower mold part and upper mold part over a great range. Instead, values that amount to less than 2° already demonstrate sufficient improvement as compared with the compulsory centering processes usually provided in the state of the art. In individual cases, the values restricted by way of the outside dimensions of the elongated body and the implementation of restricted values for the tilting can also be determined experimentally, for example.

According to a further embodiment of the invention, the elongated body is structured as a circular-cylindrical pin that engages into a bushing disposed on the frame, provided with a circular-cylindrical inner surface, as a passage.

An exemplary embodiment that can be implemented in particularly simple manner structures the elongated body as a circular-cylindrical pin that engages into a corresponding bushing. The pin can be produced from a hardened steel, for example, so that during tilting of lower mold part relative to upper mold part, the bushing, which is also hardened, allows a relative movement of lower mold part relative to upper mold part, but in this regard, low wear values occur, so that the apparatus according to the invention is not limited with regard to its useful lifetime by material stresses in the guide means.

According to a further embodiment of the invention, the outside diameter of the circular-cylindrical pin is selected as a function of a height of the bushing along the vertical direction and an inside diameter of the bushing disposed in the frame.

To establish the maximally possible tilting, both the outside diameter of the pin and the inside diameter of the frame must be referred to, wherein the height of the bushing that is present, in the axial direction of the pin must be taken into consideration as an additional parameter. The possible tilting can thereby be established on the basis of these dimensions.

According to a further embodiment of the invention, the guide pin and/or the bushing are attached in the guide means in replaceable manner.

On the basis of the movement between guide pin and bushing, which particularly occurs also during the compaction by a shaker that is usual in molding machines, if can be advantageous, in certain application cases, to structure these components to be replaceable, in order to have a fast and simple possibility of replacement in the event of wear.

According to a further embodiment of the invention, the guide means can be screwed onto the frame of the lower mold part, laterally, outside of the mold insert and outside of the pressure punch, to the side of the upper mold part.

The invention can also be expanded to cover already existing molding machines according to this embodiment, in that the components of the guide means are subsequently affixed to the frame of the lower mold part as well as to the upper mold part, outside of the pressure punch, for example.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

In the figures, components that are similar or functionally the same are provided with the same reference symbol.

Figure 1:
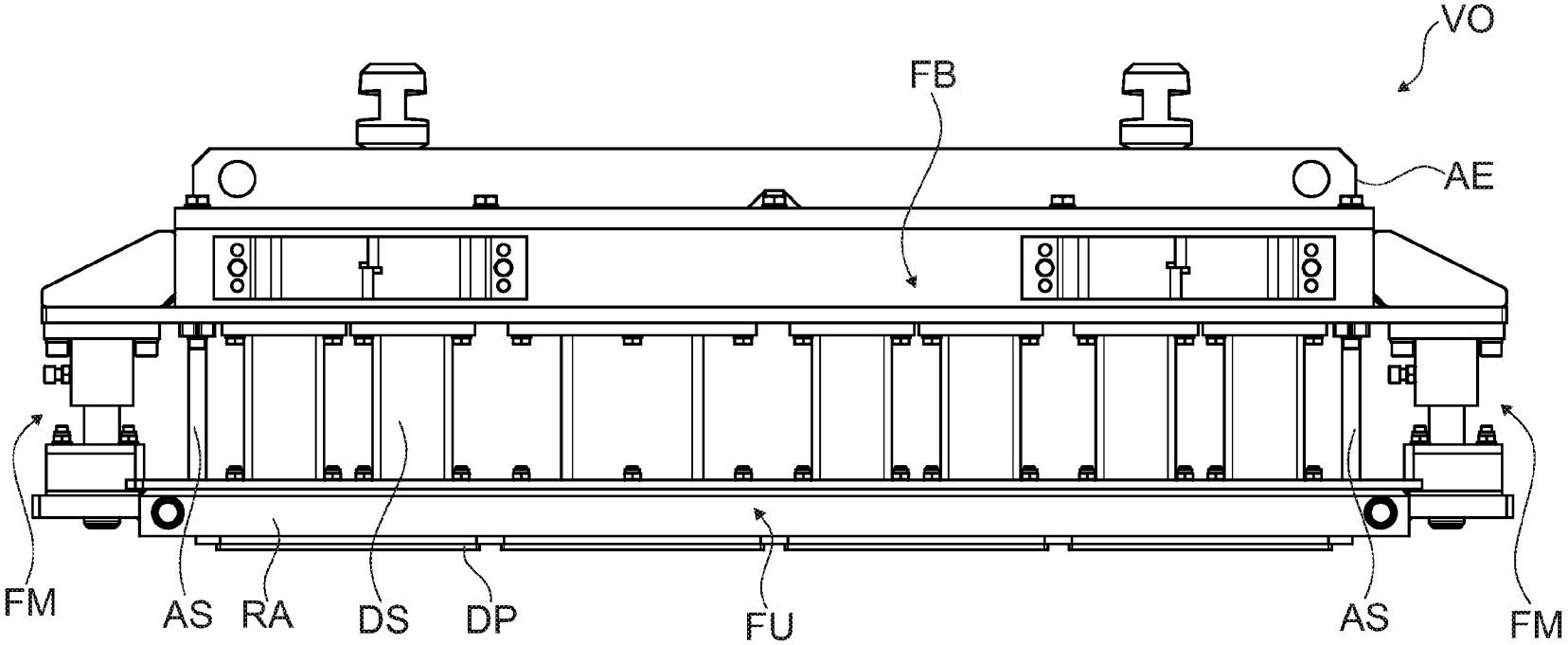
FIG. 1 is a side view of an apparatus for the production of molded concrete parts according to an embodiment of the invention.

In FIG. 1, an apparatus VO is shown, which, is suitable for the production of molded concrete parts in a molding machine. The apparatus VO has a mold disposed in replaceable manner, which is formed by a lower mold part FU and an upper mold part FB. The lower mold part FU has a mold insert, in a manner usual in technology, which insert has a correspondingly selected number of openings, so that molded concrete parts can be produced in the desired number or size, using the apparatus VO.

The upper mold part FB has a plurality of pressure plates DP, wherein each pressure plate DP corresponds with an opening in the lower mold part FU. The pressure plates DP are connected with the punch plate ST by way of a pressure punch DS, in each instance.

Above the punch plate ST, a top-load device AS is provided, which can compress a concrete mixture introduced into the openings of the mold insert in the lower mold part FU as a fill material, by way of the pressure punch DS. The top-load element AE has attachment elements on its top side, which elements, together with further elements, which are not, however, the object of the present invention, allow accommodation of the top-load element AE in a molding machine.

The lower mold part is usually made available with a plurality of openings, wherein the openings that form the mold insert are surrounded by a frame RA. A guide means FM is disposed between the frame RA of the lower mold part FU and the upper mold part FB, which means ensures alignment of the lower mold part FU relative to the upper mold part FB.

In this regard, the guide means FM can be divided into individual units, which, as shown in FIG. 1, are disposed on two opposite sides of the frame RA, which is usually in rectangular shape. To clarify the function of the guide means FM, the plane spanned by the pressure plates DP will be referred to as the xy plane below. The z direction is situated in the direction vertical to the xy plane, i.e. along the pressure punch DS. The guide means FM is configured in such a manner that the lower mold part FU can tilt slightly relative to the upper mold part FB. In this regard, tilting is understood to be a deviation from the xy plane, so that when the pressure plates dip into the mold inserts of the lower mold part FU, formerly parallel sections of the upper mold part FB and of the lower mold part FU demonstrate an angle relative to one another in the case of tilting. In this regard, tilting can take place not just along the x direction or the y direction, because it is particularly provided that tilting with regard to both directions is also intended to be possible.

Figure 2:
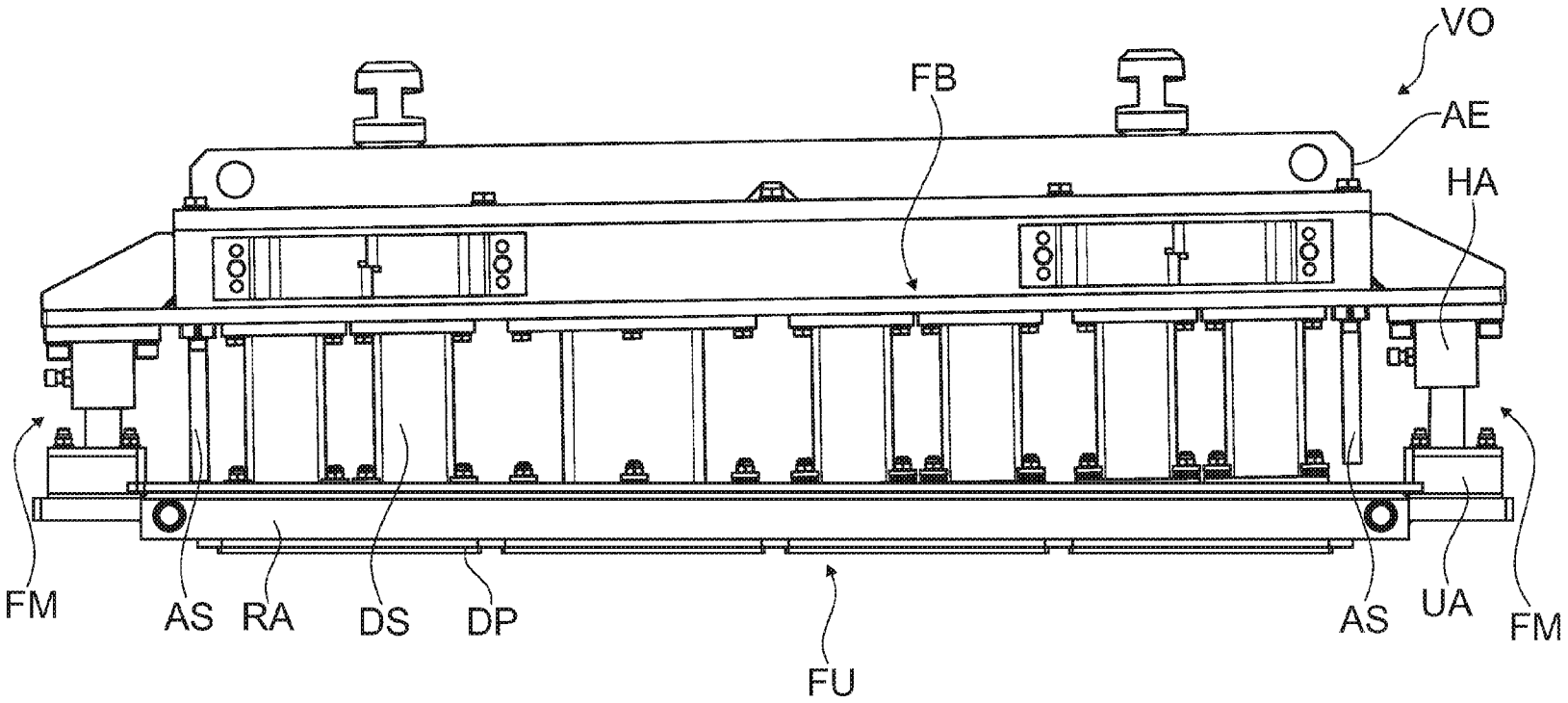
FIG. 2 is a side view of the apparatus from FIG. 1 in a tilted position.

A correspondingly tilted arrangement of the apparatus VO is shown in FIG. 2. It can be seen that the stops AS, which usually bring about delimitation of the extent to which the pressure plates DP dip into the mold inserts of the lower mold part FU in the case of complete filling, do not simultaneously rest on the frame RA or on the lower mold part FU. In this regard, it should be noted that the representation shown in FIG. 2 is greatly exaggerated, because the angle that is formed between the tilted and the parallel state lies in the range of about 1°.

Figure 3:
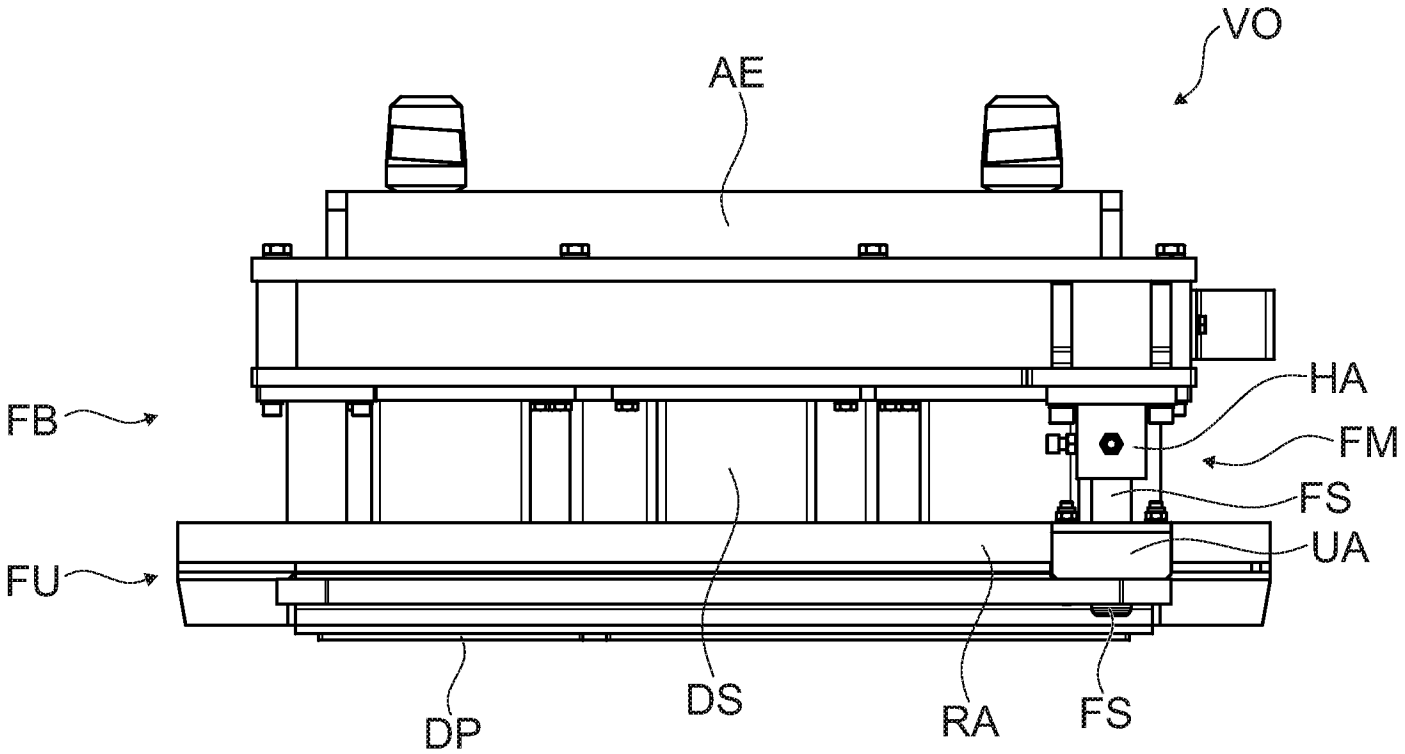
FIG. 3 is a further side view of the apparatus from FIG. 1.

In FIG. 3, the apparatus VO is shown in a side view once again. It can be seen that the guide means FM does not have to be disposed centrally in the middle of the frame RA of the lower mold part FU or of the upper mold part FB. Furthermore, it can be seen in FIG. 3 that the guide means FM has a lower section into which a cylindrical guide pin FS can dip. In this regard, the lower section is configured as a bushing, wherein, the guide pin FS has a certain play within the bushing, which has a cylindrical inside. The guide pin FS is attached to the upper mold part FB by means of a holder HA, wherein the lower section of the guide means FM can be screwed onto the lower mold part FU. This method of procedure allows simple retrofitting of already existing apparatuses VO.

Figure 4:
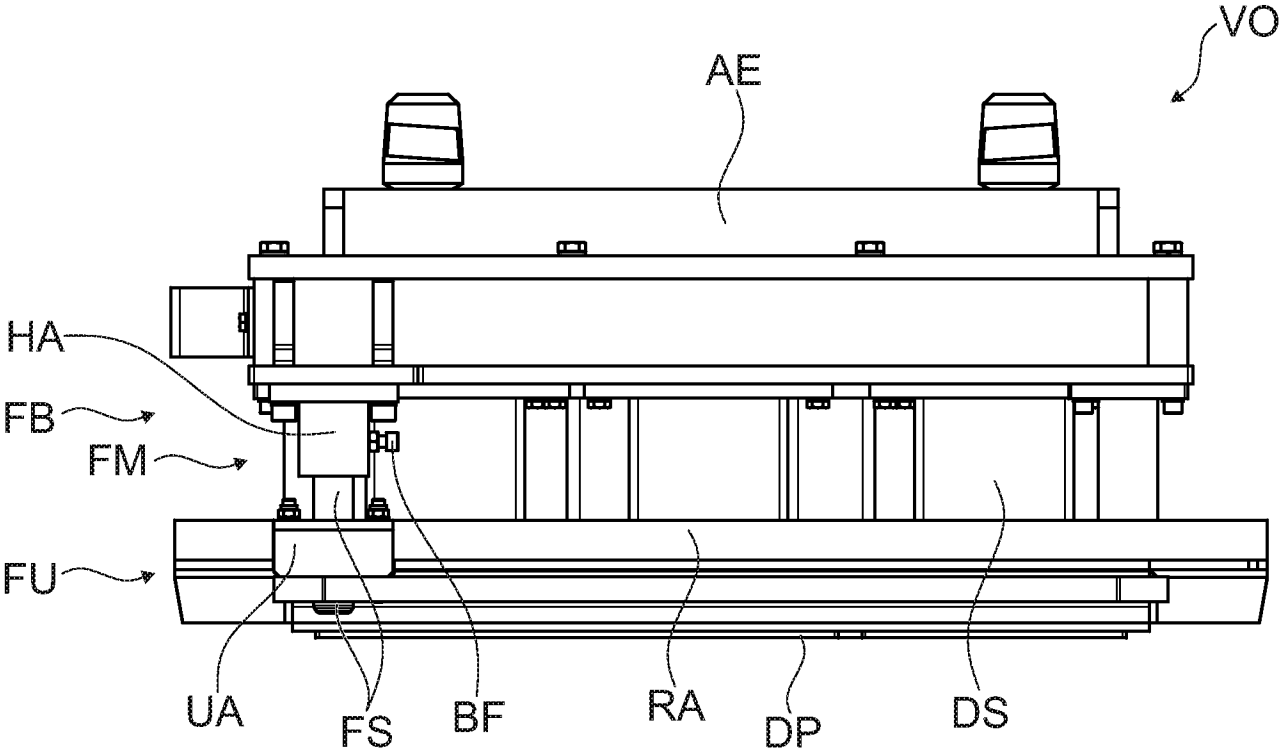
FIG. 4 shows the apparatus from FIG. 1, from a direction that lies opposite in comparison with FIG. 3.

In FIG. 4, the side view of FIG. 3 is shown once again from the opposite side. In this connection, the affixation of the guide means FM is selected to be identical to the opposite side, wherein here, too, other configurations are conceivable. Furthermore, an attachment screw BF is shown, which holds the guide pin FS of the guide means FM. Accordingly, it is possible to replace a guide pin FS or multiple guide pins FS, for example after extended operation of the apparatus VO.

Figure 5:
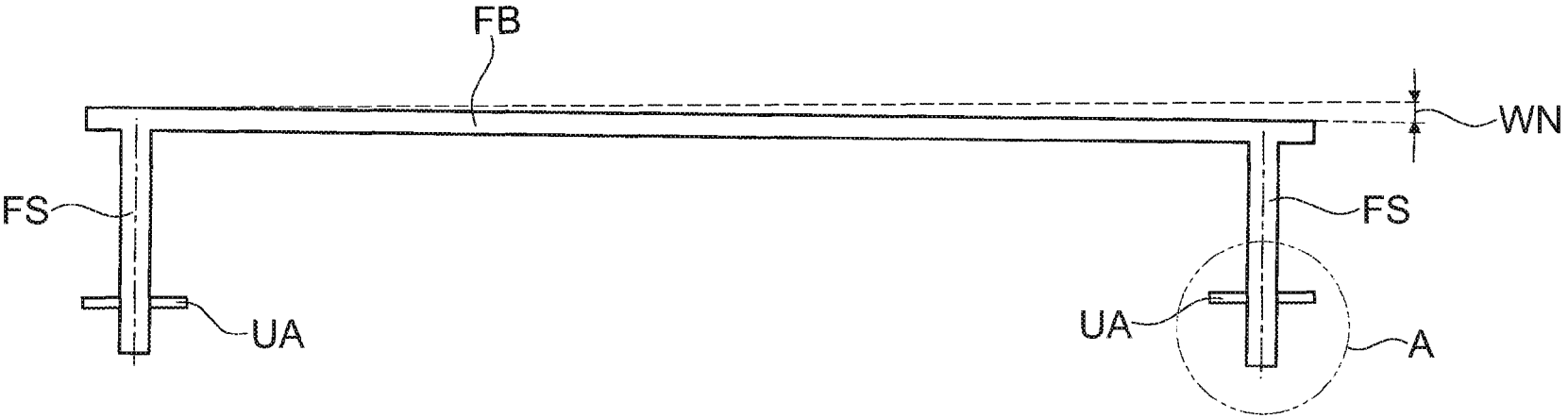
FIG. 5 shows schematic components of the apparatus from FIG. 1.

In FIG. 5, the tilting of the lower mold part FU relative to the upper mold part FB is shown once again, in a schematic view. In this schematic representation, two guide pins FS are shown, in each instance, which, as has already been described in connection with FIGS. 1 to 4, are affixed to the upper mold part FB outside of the pressure punch DS. The lower mold part, which is shown in FIG. 5 merely as a lower support UA, can, as has already been mentioned, accommodate the guide pins FS outside of the frame RA. Because of the selected dimensioning within the passage of the lower support DA, tilting of the lower mold part FU relative to the upper mold part FB is thereby possible; this tilting is shown schematically in FIG. 5, using the angle WN. In this regard, the angle WN can amount to less than 2°, wherein a value of about 1° has proven to be particularly advantageous. The restriction of the angle WN is advantageously achieved by the dimensioning of the guide pin FS in the passage within the lower support UA, as is indicated as Detail A in FIG. 5, shown once again magnified in FIG. 6.

Figure 6:
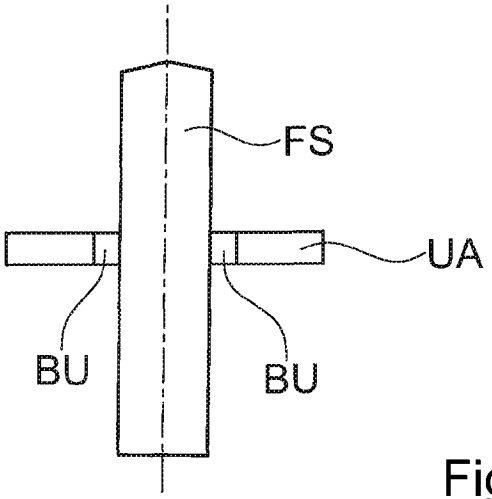
FIG. 6 is a schematic view of a detail of the apparatus from FIG. 5.

In FIG. 6, Detail A is shown in a sectional view, wherein a bushing BU is indicated within the lower support UA, which bushing delimits the circular-cylindrical outer surface of the guide pin FS with its circular-cylindrical inner surfaces. The inside diameter of the bushing BU as well as the outside diameter of the guide pin FS can be calculated without difficulty if the height of the bushing BU as well as the distances of the two guide pins FS from one another are known. In order to achieve tilting of less than 1° at a distance of approximately 1.5 m of the two guide pins FS from one another, for example, the guide pin having an outside diameter of 40 mm can engage into a bushing BU having a height of 14 mm. The inside diameter of the bushing BU is selected to be about 10% greater than the outside diameter of the guide pin FS, in order to achieve the desired tilting of less than 1° of the angle WN.

The characteristics that are indicated above and in the claims, as well as that are evident in the figures, can advantageously be implemented both individually and in various combinations. The invention is not restricted to the exemplary embodiments described, but rather can be modified in many different ways, within the scope of the ability of a person skilled in the art.

Thus, although only some exemplary embodiments of the present invention have been shown and described, it is to be understood that many changes and modifications may be made thereunto without departing from the spirit and scope of the invention.

What is claimed is:

1. An apparatus for producing concrete molded parts in a molding machine, the apparatus comprising:

(a) a lower mold part;

(b) a mold insert disposed in the lower mold part and having an opening;

(c) at least one pressure plate introduceable into the opening of the mold insert in a vertical direction;

(d) an upper mold part having at least one pressure punch for transfer of a force to the at least one pressure plate; and (e) a frame surrounding the lower mold part, said frame comprising at least a first guide connected with the upper mold part and configured so that the lower mold part can be tilted from the vertical direction, relative to the upper mold part, during engagement of the at least one pressure plate into the opening of the mold insert.

2. The apparatus according to claim 1, further comprising a second guide, wherein the frame has a first side and a second side opposite to the first side and the first and second guides are disposed on the first and second sides of the frame, respectively.

3. The apparatus according to claim 1, wherein the first guide comprises an elongated body configured along the vertical direction, having parallel side lines relative to the vertical direction, at least in certain sections, said elongated body engaging into an at least partially corresponding passage.

4. The apparatus according to claim 3, wherein the elongated body is connected with the upper mold part and the passage is connected with the lower mold part.

5. The apparatus according to claim 4, wherein the elongated body and the passage have dimensions that are selected so that a maximal value of tilting of the lower mold part relative to the upper mold part is predetermined.

6. The apparatus according to claim 1, wherein the lower mold part is configured to tilt relative to the upper mold part by an angle that lies in the range of less than 2°.

7. The apparatus according to claim 6, wherein the angle is approximately 1°.

8. The apparatus according to claim 3, wherein the elongated body is structured as a circular-cylindrical pin that engages into a bushing disposed on the frame provided with a circular-cylindrical inner surface, as a passage.

9. The apparatus according to claim 8, wherein the circular-cylindrical pin has an outside diameter selected as a function of a height of the bushing along the vertical direction and an inside diameter of the bushing disposed in the frame.

10. The apparatus according to claim 8, wherein at least one of the circular-cylindrical pin and the bushing is replaceably attached in the first guide.

11. The apparatus according to claim 1, wherein the first guide is configured to be screwed onto the frame, laterally, outside of the mold insert and outside of the at least one pressure punch, to a side of the upper mold part.

* * * * *